US010611010B1

(12) United States Patent
Anderson

(10) Patent No.: US 10,611,010 B1
(45) Date of Patent: Apr. 7, 2020

(54) SLIDING CENTER OF GRAVITY HAMMER

(71) Applicant: Travis Jay Anderson, Orion, IL (US)

(72) Inventor: Travis Jay Anderson, Orion, IL (US)

( * ) Notice: Subject to any disclaimer, the term of this patent is extended or adjusted under 35 U.S.C. 154(b) by 179 days.

(21) Appl. No.: 15/831,005

(22) Filed: Dec. 4, 2017

Related U.S. Application Data

(60) Provisional application No. 62/497,789, filed on Dec. 2, 2016.

(51) Int. Cl.
*B25D 1/04* (2006.01)
*B25G 1/10* (2006.01)

(52) U.S. Cl.
CPC ..... *B25D 1/04* (2013.01); *B25G 1/10* (2013.01); *B25D 2250/005* (2013.01); *B25D 2250/391* (2013.01)

(58) Field of Classification Search
CPC ..... B25D 1/04; B25D 2250/005; B25D 2250/391; B24D 2250/005; B24D 2250/391; B25G 1/10
USPC ..... 81/25–28
See application file for complete search history.

(56) References Cited

U.S. PATENT DOCUMENTS 404,001 A * 5/1889 Heacock ..... B25F 1/006 7/139
1,304,647 A * 5/1919 Basta ..... B25D 1/00 81/20
1,585,190 A * 5/1926 Girdwood ..... A63B 53/02 473/334
1,822,280 A 9/1931 Ervay
2,051,083 A * 8/1936 Hart ..... A63B 60/24 473/297
2,604,914 A 7/1952 William
3,130,762 A 4/1964 Kerr
3,185,146 A * 5/1965 Leopoldi ..... A61B 9/00 600/553
3,444,908 A 5/1969 Roth
4,697,481 A 10/1987 Maeda
4,831,901 A 5/1989 Kinne
4,998,996 A 3/1991 Belanger
5,099,724 A * 3/1992 Reddy, Jr. ..... B25G 1/04 81/177.2
6,347,562 B1 2/2002 Gerber
6,460,210 B1 10/2002 Alpert
7,013,516 B1 3/2006 Peters
7,836,534 B2 11/2010 Simmons
2014/0216210 A1* 8/2014 Near ..... B25D 1/02 81/25

(Continued)

FOREIGN PATENT DOCUMENTS

WO 2005025811 A1 3/2005

*Primary Examiner* — Hadi Shakeri
(74) *Attorney, Agent, or Firm* — Hamilton IP Law, PC; Jay R. Hamilton; Charles A. Damschen

(57) ABSTRACT

A sliding center of gravity hammer is disclosed herein allows the user to slide a heavy weight to various positions in the barrel of the hammer for different applications. When more force is needed to drive a nail, the heavy weight could be locked in the first position which is closest to the hammer head. When less force is needed, the heavy weight could be locked in the third position which is closest to the handle end. The embodiment allows the user to adjust the weight of the hammer to the user's needs when working on many different applications which increases the operation efficiency and reduces risk of injury to the user.

9 Claims, 7 Drawing Sheets

(56) References Cited

U.S. PATENT DOCUMENTS

2016/0243691 A1 8/2016 Nicholls

* cited by examiner

SLIDING CENTER OF GRAVITY HAMMER

CROSS REFERENCE TO RELATED APPLICATIONS

This application claims priority from provisional U.S. Pat. App. No. 62/497,789 filed on Dec. 2, 2016 which is incorporated by reference herein in its entirety.

FIELD OF THE INVENTION

The present disclosure relates to an adjustable hammer, and in particular it relates to a sliding center of gravity hammer which allows the user to adjust the weight for different applications, as shown and disclosed herein.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. § 1.171 (d)(c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

SUMMARY OF THE INVENTION

The sliding center of gravity hammer is configured to deliver a heavy blow to an object such as a nail. The sliding center of gravity hammer as disclosed herein provides multiple improvements over the prior art. The sliding center of gravity hammer and the application of a sliding weight in a hollow barrel inside the handle portion allows the user to adjust the force for different applications. When more force is needed to drive a nail or an object, the heavy metal weight could be locked in the first position which is closest to the hammer head increasing force delivered. When less force is needed, the weight could be locked in the third position which is closest to the handle end, which also makes the hammer easier to swing. In one embodiment the locking pin may be removed to allow the heavy weight to slide freely when the hammer is swinging for accelerated delivery of force to the object struck by the hammer head. The improved hammer also works efficient as a standard hammer even when the heavy metal weight is removed and/or located outside the hollow barrel, without any limitation and/or restriction.

DETAILED DESCRIPTION—BRIEF DESCRIPTION OF DRAWINGS

The accompanying drawings, which are incorporated in and constitute a part of this specification, illustrate embodiments and together with the description, serve to explain and illustrate the principles of Safety apparatus and method for securing an infant carrier as disclosed herein.

DETAILED DESCRIPTION - LISTING OF ELEMENTS

Figure 1:
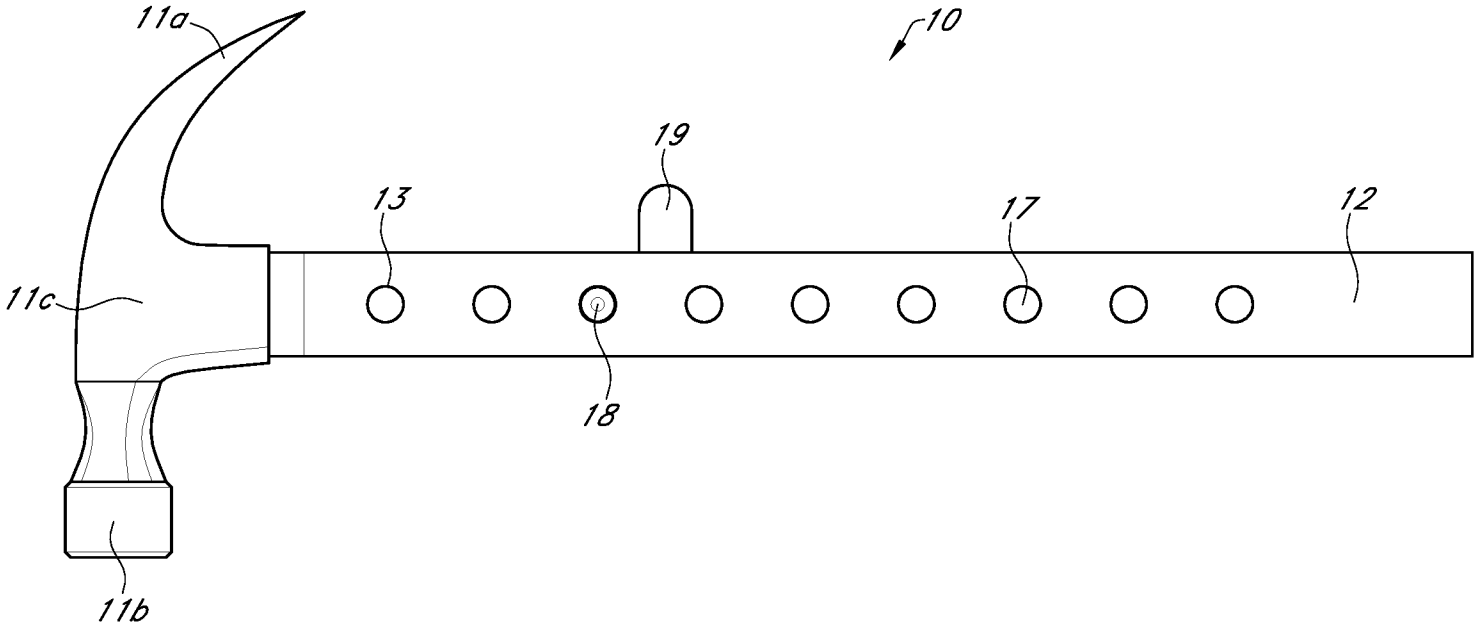
FIG. 1 is a perspective view of the Sliding Center of Gravity Hammer having a head and a handle disclosed herein along with detailed call-outs for enablement of the present disclosure.

| Element Description | Element Number |
|---|---|
| Nails (not shown) | 1 |
| | 2 |
| Sliding Center of Gravity Hammer | 10 |
| Head | 11 |
| First end (Claw) | 11a |
| Second end (Anvil) | 11b |
| Body | 11c |
| Opening | 11d |
| Attached Bar | 11e |
| Handle | 12 |
| Upper portion | 12a |
| Body | 12b |
| Lower portion | 12c |
| Holes | 13 |
| Shaft | 14 |
| Groove | 15 |
| Barrel (hollow) | 16 |
| Weight (heavy) | 17 |
| Locking pin (depressible) | 18 |
| Tab | 19 |
| | 20 |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like “front”, “back”, “up”, “down”, “top”, “bottom”, and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

Housing market and service and repair industry are growing and become a great demand upon construction and repair professionals for quick and efficient performance. However, hammers have been virtually unchanged since invented. The conventional hammer has a problem that when the hammer is moved to strike an object, the impact is transmitted to the user's hand directly which increases efforts and labor of the user. Consequently, it reduces the operating efficiency and increases risk of injury to the user. In order to alleviate the problem, numerous adjustable weight hammers have been provided in prior art that are adapted an effective means of reducing load weight while eliminate the risk of injury. As shown, the present embodiment is directed to a new and improved hammer having a heavy weight and a hollow barrel imbedded in the handle portion which allows the user to slide and adjust the weight and applied force of the hammer. Dependent on any particular application, the sliding center of gravity hammer works efficiently with the heavy weight to allow adjustment to various positions, illustrated by sliding or insertion but not so limited, inside the handle which allows the user to work on many different sized jobs while potentially reducing user injury. When less force is needed, the heavy metal weight could be locked at the position closest to the handle. When more force is needed to perform a work such as driving a nail, the heavy metal weight could be locked into the position closest to the hammer head.

ILLUSTRATIVE EMBODIMENT AND ADVANTAGES OF INVENTION

Before the present Sliding Center of Gravity Hammer 10 is disclosed and described, it is to be understood that the Sliding Center of Gravity Hammer 10 is not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As one of ordinary skill will appreciate the present disclosure is not limited by the means of construction or the materials chosen as other suitable materials, including plastic, nylon, steel or aluminum, and combinations therein.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

"Optional" or "optionally" means that the subsequently described event or circumstance may or may not occur, and that the description includes instances where said event or circumstance occurs and instances where it does not.

As one of ordinary skill will appreciate the present disclosure is not limited by the means of construction or the materials chosen as other suitable materials, including plastic, steel or aluminum, and combinations therein.

Disclosed are components that can be used with at least one embodiment of the disclosed Sliding Center of Gravity Hammer 10. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all potential embodiments of the Sliding Center of Gravity Hammer 10. This applies to all aspects of this application including, but not limited to, components of a Sliding Center of Gravity Hammer 10. Thus, if there are a variety of additional components that can be added it is understood that each of these additional components can be added with any specific embodiment or combination of embodiments of the Sliding Center of Gravity Hammer 10. The present Sliding Center of Gravity Hammer 10 may be understood more readily by reference to the following detailed description of preferred embodiments and the examples included therein and to the Figures and their previous and following description.

In one embodiment, the Sliding Center of Gravity Hammer 10 may be constructed of material of sufficient strength and durability for use in delivering heavy blows against the surface being struck and or maintaining integrity and optimum safety when used as a hammering or striking tool. It is contemplated that in the illustrative embodiment shown in the enclosed figures may be constructed of, but not limited to, any metal or combination of metals including bronze, steel and aluminum; plastics or carbon fiber including Kevlar®, foam-blown polyurethane, thermoplastic polyurethane, ethylene vinyl acetate, other polymers, other thermoplastics, carbon rubber, blown rubber polymers, composite materials, natural materials (e.g., rubber, leather, etc.), elastomers, combinations thereof, and/or any other material with suitable characteristics (e.g., compressive strength, stability, elasticity, density).

FIG. 1 is a perspective view of the sliding center of gravity hammer 10 having a head 11 and a handle 12 disclosed herein along with detailed call-outs for enablement of the present disclosure. As shown, the sliding center of gravity hammer 10, generally designated, comprises a head 11, a heavy weight 17 and a handle 12. The head 11, having a first end 11*a* and a second end 11*b*, is attached to the handle 12 via an opening 11*d*. The first end 11*a* of the head can be used as a claw and is adapted for removing nails 1 or tacks, and the like from a surface while the second end lib of the head with a striking face is adapted for striking a nail 1 or a tack. The head 11 may be constructed of, but not limited to, a metal, such as steel and aluminum, or some other solid, durable, and hard material. The handle 12 can be formed from a metal, such as steel, or molded plastic, or from wood, or a combination thereof. One of ordinary skill will appreciate that depending on the materials selected, the head 11 and the handle 12 can be constructed together or constructed separately and conventionally attached together. As illustrated, the attachment configuration does not require complex manufacturing; therefore, the production of the device would be relatively economical and low maintenance cost.

Figure 2:
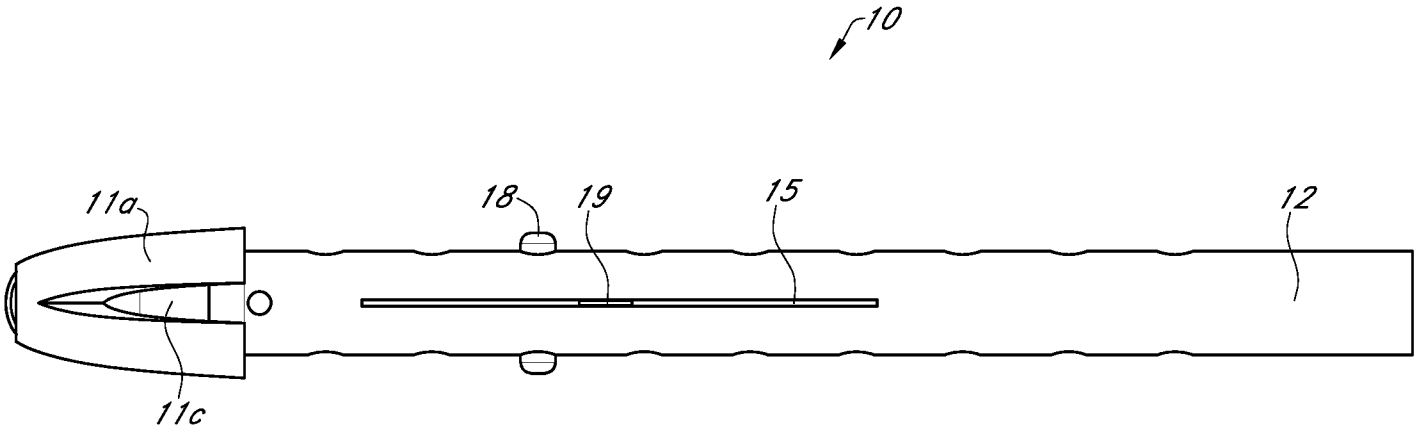
FIG. 2 is a left-side perspective view of the Sliding Center of Gravity Hammer with the tab attached to the heavy weight and positionable on the handle as disclosed herein.
Figure 3:
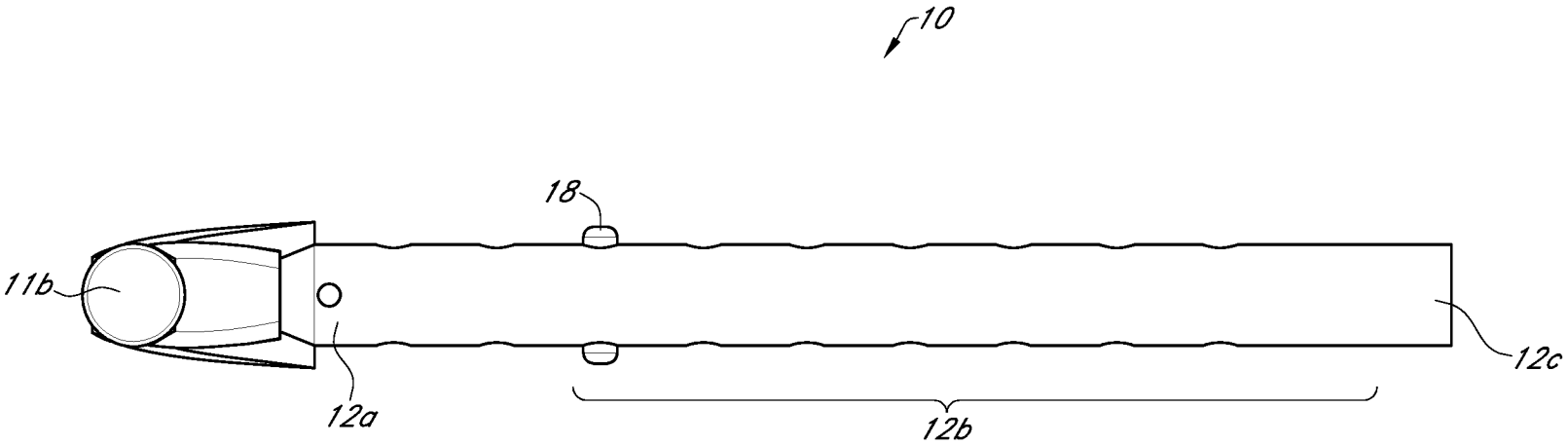
FIG. 3 is a right-side perspective view of the Sliding Center of Gravity Hammer along with detailed call-outs as disclosed herein.

FIG. 2 is a left-side perspective view of the sliding center of gravity hammer 10 with the tab attached to the heavy weight 17 and positionable in the groove 15 on the handle 12 as disclosed herein. FIG. 3 is a right-side perspective view of the sliding center of gravity hammer 10 along with detailed call-outs as disclosed herein. As shown in FIGS. 2-3, the sliding center of gravity hammer 10 comprises the handle 12 configured of an upper portion 12*a*, a body 12*b* and a lower portion 12*c* wherein the upper portion 12*a* is connected to the head 11 and the lower portion 12*c* may be configured as an open end for inserting the heavy weight 17. The body 12*b* of the handle generally has a cylindrical shape and longitudinally extends from the upper portion 12*a* (the head) to the lower portion 12*c* (the end). An end cap (not shown) may be provided and is adapted to engage with the lower portion 12*c* of the handle. As shown, a plurality of holes 13 position along the length of the handle 12 wherein each hole 13 forms a bore through the handle 12 and is in communication with the barrel 16, without any limitation and restriction. The holes 13 are generally the same shape and dimension with a locking pin 18 allowing the locking pin 18 to be locked in the hole 13 and secure the heavy weight 17 to the handle 12. One of ordinary skill will appreciated that the locking pin 18 is removable and depressible for easy use and assembly. The user can press down the locking pin while sliding the heavy weight 17 from one hole 13 to another hole 13, without any limitation and/or restriction. There is a groove 15 extending along the side of the handle body 12*b*. A tab 19 is located along the groove 15 and is attached to the heavy weight 17. One of ordinary skill will also appreciate that the tab 19 is positioned in such a manner that allows the user to slide the heavy weight 17 up and down along the length of the handle 12.

Another aspect of the embodiment is the heavy weight 17 located inside the barrel 16 of the handle. The heavy weight 17 is configured with a tab 19 and a depressible locking pin 18 wherein the heavy weight 17 is positionable in the barrel 16 with the tab 19 positionable in the groove 15 and the depressible locking pin 18 configured to engage with the holes 13. One of ordinary skill will appreciate that the user can slide the heavy weight 17 along the groove 15 toward the head 11 when more force is needed and toward the lower portion 12*c* of the handle when less force is needed. One of ordinary skill will appreciate that the center of gravity of the hammer may be adjusted by sliding the tab 19 along with the groove 15 to reposition the heavy weight 17 between the holes 13.

Figure 4:
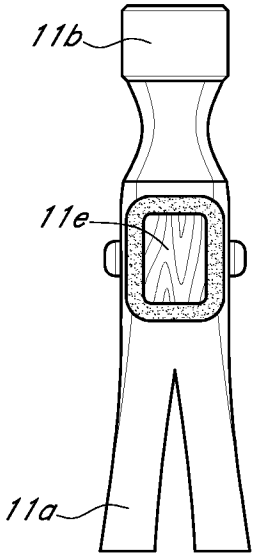
FIG. 4 is a top perspective view of the Sliding Center of Gravity Hammer with an opening at the center of the head as disclosed in FIG. 1 herein.

As shown and illustrated herein, FIG. 4 is a top perspective view of the Sliding Center of Gravity Hammer 10 with an opening 11*d* at the center of the head as disclosed in FIG. 1 herein. Without any limitation and restriction, the opening 11*d* inside the head 11 is configured for the attachment of the handle 12. The opening 11*d* may be constructed as round, square or rectangle shape and is positioned at the center of the head 11. An attached bar 11*e* passes through the opening 11*d* of the head and an upper portion 12*a* of the handle for engaging and securing the head 11 in a manner which would provide safe usage of the hand tool.

Figure 5:
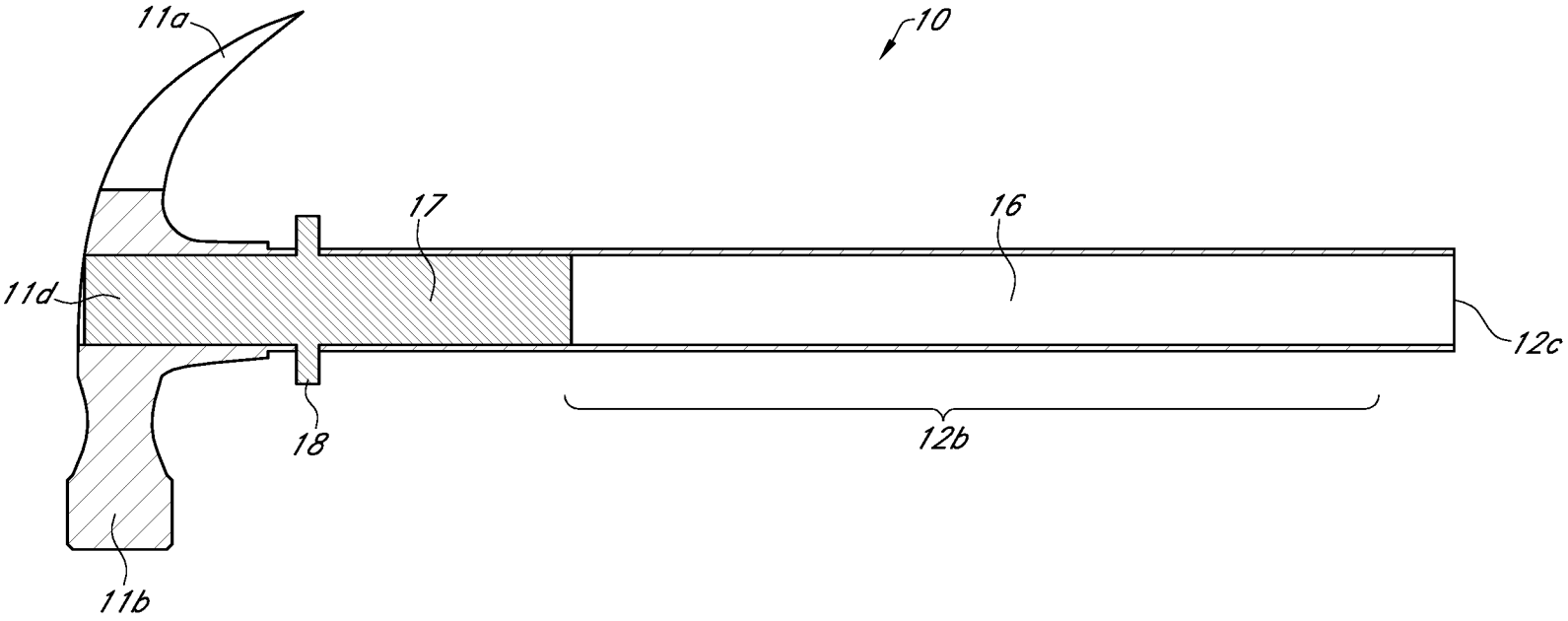
FIG. 5 is a detailed view of another embodiment of the Sliding Center of Gravity Hammer without a tab and groove and having a removable locking pin and weight positioned at the first position as disclosed herein.
Figure 6:
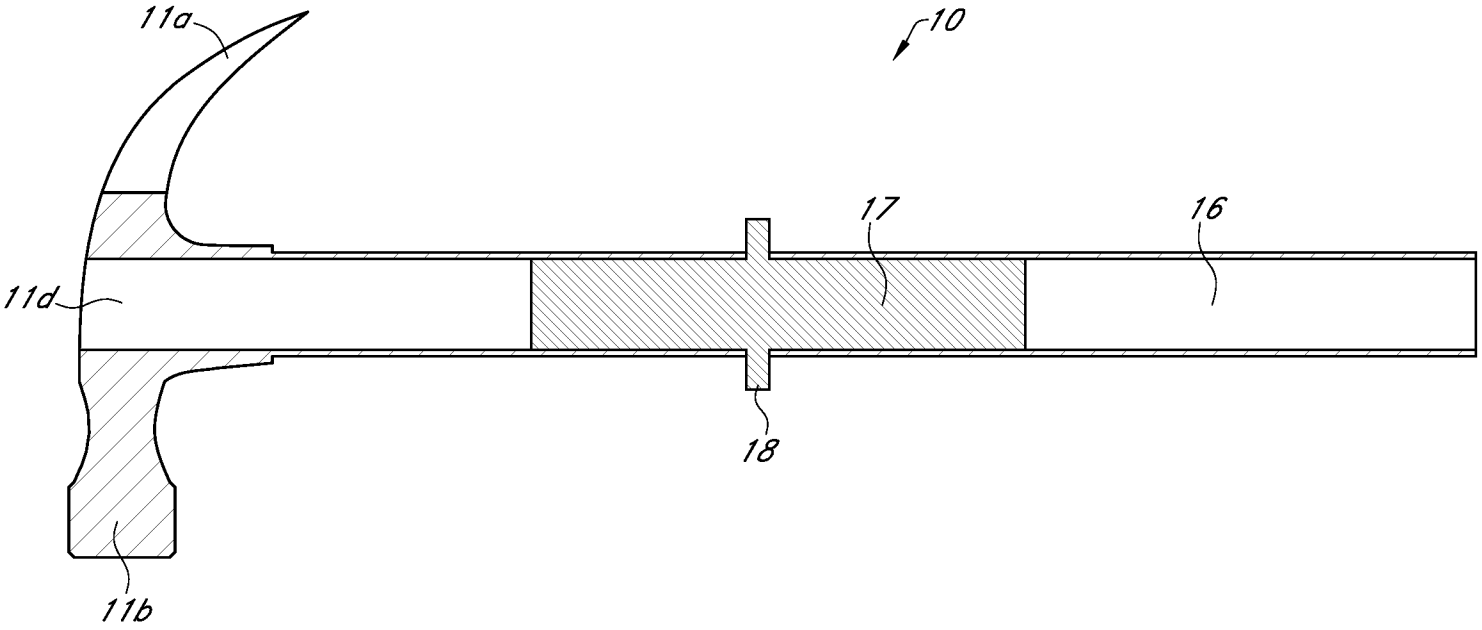
FIG. 6 is a detailed view of the embodiment of FIG. 5 of the Sliding Center of Gravity Hammer having the removable locking pin and weight positioned at the second position as disclosed herein.
Figure 7:
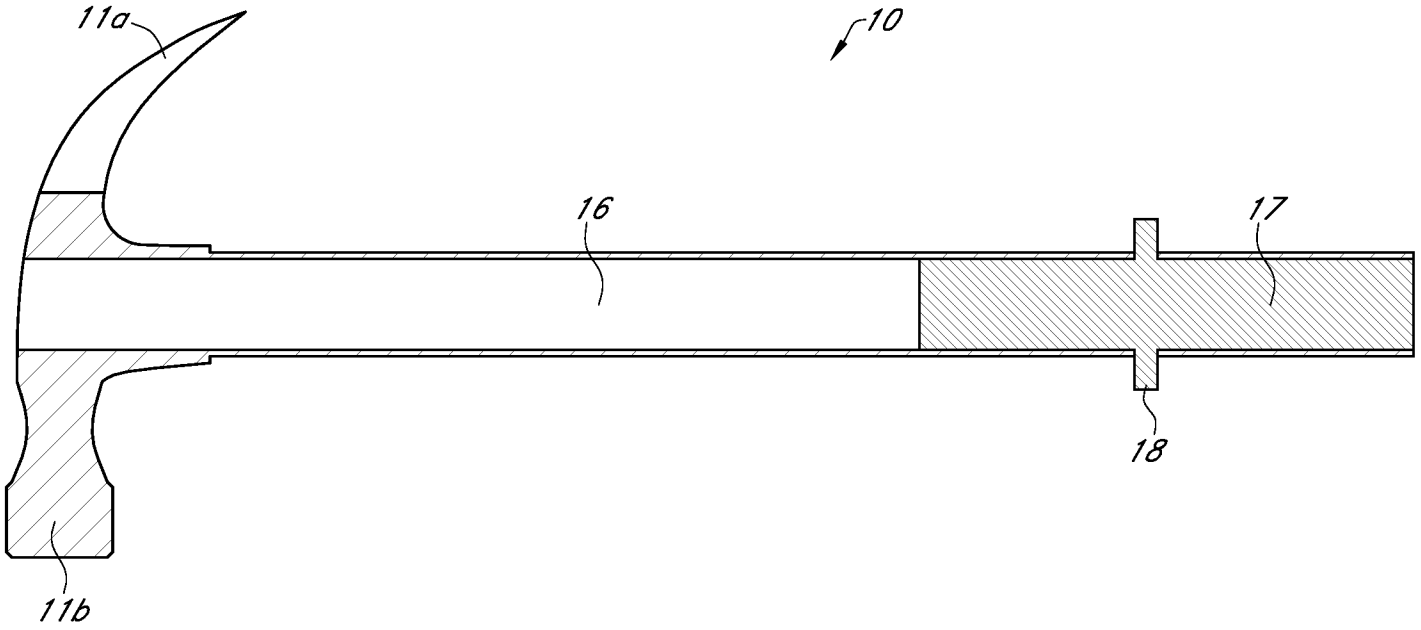
FIG. 7 is a detailed view of another embodiment the Sliding Center of Gravity Hammer having the removable locking pin and weight positioned at the third position as disclosed herein.

Another embodiment of the sliding center of gravity hammer 10 is shown in FIGS. 5-7. FIG. 5 is a detailed view of another embodiment of the sliding center of gravity hammer 10 without a tab 19 and groove 15 and having a removable locking pin 18 and weight 17 positioned at the first position as disclosed herein. FIG. 6 is a detailed view of the embodiment of FIG. 5 of the sliding center of gravity hammer 10 having the removable locking pin 18 and weight 17 positioned at the second position as disclosed herein. FIG. 7 is a detailed view of another embodiment the sliding center of gravity hammer 10 having the removable locking pin 18 and weight 17 positioned at the third position as disclosed herein. As shown and illustrated, the embodiment 10 comprises of a head 11, a heavy weight 17 located in the barrel 16 and a handle 12 wherein the head 11 and the handle 12 are integrally formed. The handle 12 is not configured with the groove 15 and the weight 17 is not configured with a tab 19. When the locking pin 18 is removed, the heavy weight 17 can slide freely to various positions when the hammer is swinging for accelerated delivery of force to the object struck be the hammer head 11. After sliding the heavy weight 17 to the desired position, the heavy weight 17 can be locked secured by a locking pin 18. One of ordinary skill will appreciate that the locking pin 18 can be depressible and/or removable allowing the insertion and sliding of the heavy weight 17 inside the barrel 16.

In addition, as shown and illustrated, when more force is needed for the user to swing the hammer, the heavy weight 17 will be locked in the first position which is close to the hammer head 11. In contrast, when less force is needed, the heavy weight 17 will be locked in the third position which is close to the second end 12*c* of the handle, which also makes the hammer easier to swing. When an even force is needed, dependent on a particular application, the heavy weight 17 can be locked at a second position which is at the middle of the body 12*b* of the handle. The sliding center of gravity hammer 10 can function as a standard hammer when the heavy weight 17 is removed, without any limitation and/or restriction. One of ordinary skill will appreciate that the sliding center of gravity hammer 10 increases the operating efficiency and reduces the risk of injury to the user. The production of the sliding center of gravity hammer 10 is relatively inexpensive and low maintenance cost.

It should be noted that Sliding Center of Gravity Hammer 10 are not limited to the specific embodiments pictured and described herein, but is intended to apply to all similar apparatuses and methods for providing the various benefits of those elements, which such benefits are explicitly and/or inherently disclosed herein. Modifications and alterations from the described embodiments will occur to those skilled in the art without departure from the spirit and scope of the embodiment. Furthermore, variations and modifications of the foregoing are within the scope of the Sliding Center of Gravity Hammer 10. It is understood that Sliding Center of Gravity Hammer 10 as disclosed herein extends to all alternative combinations of one or more of the individual features mentioned, evident from the text and/or drawings, and/or inherently disclosed. All of these different combinations constitute various alternative aspects of the Sliding Center of Gravity Hammer 10. The embodiments described herein explain the best modes known for practicing the Sliding Center of Gravity Hammer 10 and will enable others skilled in the art to utilize the same. The claims are to be construed to include alternative embodiments to the extent permitted by the prior art.

What is claimed is:

1. A sliding center of gravity hammer comprising:

a) a handle having a length and a width configured for user engagement, the handle having an interior barrel formed along its length, with at least one groove extending along the length of the barrel positioned therein;

b) at least two holes positioned along the length of the handle, the at least two holes in communication with the barrel, each forming a bore in the barrel;

c) a weight positioned in the barrel and configured with at least one tab and at least one depressible locking pin, wherein the center of gravity of the hammer may be adjusted by sliding the tab along the groove to reposition the weight between the at least two holes; and, d) a head having a first end and a second, the head configured to deliver a blow, the head having at least one opening for attachment to the handle.

2. The sliding center of gravity hammer according to claim 1 wherein the groove is generally perpendicular to the bore of the at least two holes.

3. The sliding center of gravity hammer according to claim 1 wherein the at least two holes are linearly aligned along the length of the handle.

4. A sliding center of gravity hammer comprising:

a) a handle having a length and a width configured for user engagement, the handle having an interior barrel formed along its length, with a groove positioned therein, the groove extending along the length of the barrel;

b) at least two pairs of holes positioned along the length of the handle, the at least two pairs of holes in communication with the barrel, each pair of holes forming a bore through the barrel;

c) a weight configured with a tab and a depressible locking pin, wherein the weight is position in the barrel and the depressible locking pin configured to engage with either of the at least two pairs of holes, wherein the center of gravity of the hammer may be adjusted by sliding the tab along the groove to reposition the weight between the at least two pairs of holes; and, d) a head having a first end and a second, the head configured to deliver a blow, the head having at least one opening for attachment to the handle.

5. The sliding center of gravity hammer according to claim 4 wherein the bore through the barrel of the handle is generally perpendicular to the groove.

6. The sliding center of gravity hammer according to claim 4 wherein the at least two holes are linearly aligned along the length of the handle.

7. A sliding center of gravity hammer comprising:

a) a handle having a length, a width, a first end and a second end, the first end of the handle configured for user engagement, the handle having an interior barrel formed along its length, with a groove positioned therein, the groove extending along the length of the barrel from the handle first end to the second end;

b) a plurality of holes positioned along the length of the handle, wherein each hole forms a bore through the barrel;

c) a weight configured with a tab and a depressible locking pin, wherein the weight is position in the barrel with the tab positionable in the groove and the depressible locking pin is configured to engage with the bore of the plurality of holes, wherein the center of gravity of the hammer may be adjusted by sliding the tab along the groove to reposition the weight between the plurality of holes; and, d) a head having a first end and a second, the head is configured to deliver a blow, the head having at least one opening for attachment to the second end of the handle.

8. The sliding center of gravity hammer according to claim 7 wherein the bore through the barrel of the handle is generally perpendicular to the groove.

9. The sliding center of gravity hammer according to claim 7 wherein the at least two holes are linearly aligned along the length of the handle.

* * * * *